US008261925B2

(12) United States Patent
Murphy

(10) Patent No.: US 8,261,925 B2
(45) Date of Patent: Sep. 11, 2012

(54) INTERLOCKING STORAGE UNITS

(75) Inventor: John J. Murphy, Freehold, NJ (US)

(73) Assignee: Apex Medical Corporation, Fort Worth, TX (US)

( * ) Notice: Subject to any disclaimer, the term of this patent is extended or adjusted under 35 U.S.C. 154(b) by 0 days.

(21) Appl. No.: 12/785,988

(22) Filed: May 24, 2010

(65) Prior Publication Data

US 2010/0288672 A1 Nov. 18, 2010

Related U.S. Application Data

(63) Continuation of application No. 11/096,846, filed on Apr. 1, 2005, now Pat. No. 7,748,554.

(60) Provisional application No. 60/559,352, filed on Apr. 2, 2004.

(51) Int. Cl.
*B65D 21/024* (2006.01)

(52) U.S. Cl. ..... 220/23.4; 220/23.2; 220/507

(58) Field of Classification Search ..... 220/4.27, 220/23.2, 23.4, 507; 206/538
See application file for complete search history.

(56) References Cited

U.S. PATENT DOCUMENTS 3,834,778 A 9/1974 Morrison et al.
4,163,496 A * 8/1979 Dogliotti ..... 206/538
4,372,445 A 2/1983 Keffeler
4,573,580 A 3/1986 Messer
4,749,085 A 6/1988 Denney
4,793,492 A 12/1988 Halbich
4,889,254 A * 12/1989 Vola ..... 220/23.4
5,050,755 A * 9/1991 Strawder ..... 220/23.4
6,006,935 A * 12/1999 Driver ..... 220/23.4
2002/0079313 A1* 6/2002 Grayson ..... 220/23.4

OTHER PUBLICATIONS

Apothecary Products, Inc. Catalogue, Sep. 2000, pp. 1-3 and 9.

* cited by examiner

*Primary Examiner* — Stephen Castellano
(74) *Attorney, Agent, or Firm* — Lee & Hayes, PLLC

(57) ABSTRACT

A pillbox comprising a plurality of compartments, each compartment having two side walls, two end walls, and a bottom and each compartment having a top, each top comprising a hinged lid for accessing the compartment, the hinged lid being hinged pivotally at a hinge area; a slot at one of the walls of each compartment disposed parallel to the one wall, further wherein the hinged lid for each compartment is separable from the compartment, each hinged lid having a tab depending from the hinged lid and being pivotable from the lid at the hinge area, the tab being insertable into the slot to secure the hinged lid to the compartment for access to the compartment, the tab being releasably and frictionally held in place in the slot and being removable from the slot integral with the lid when the lid is removed.

14 Claims, 10 Drawing Sheets

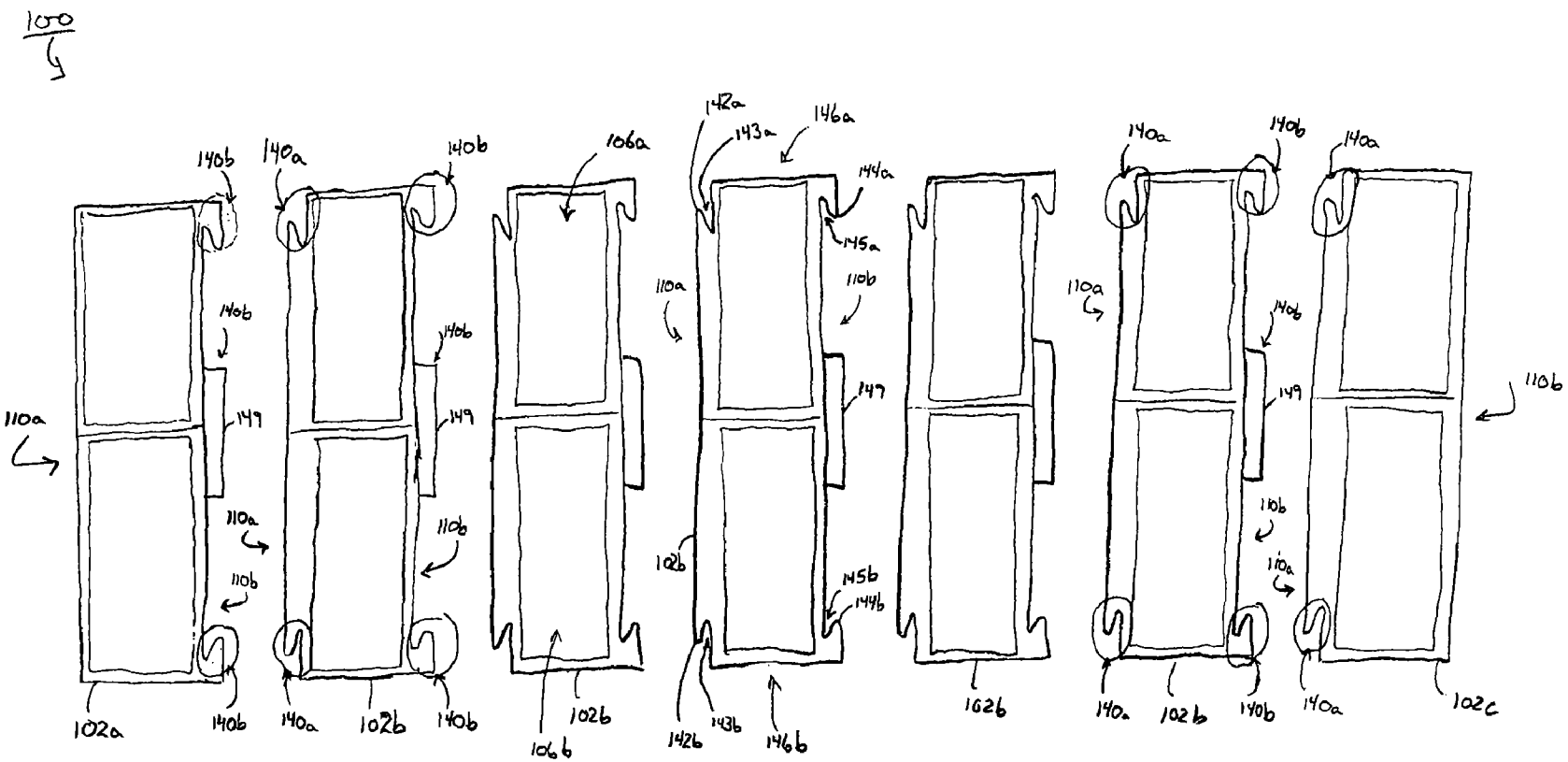
105
110a
1102a
1406
1406b
1406a
1102b
1106b
1106a
1102b
1426
1426b
1426a
1436
1436a
1446
1446a
1446b
1456
1456a
1466
1466a
1466b
1476
1476a
1476b
1486
1486a
1486b
1496
1496a
1496b
1102b
1626
1102b
1102c
1406
1406a
1406b
1406a
1406b
1406a
1406b

INTERLOCKING STORAGE UNITS

RELATED APPLICATIONS

This is a continuation of U.S. patent application Ser. No. 11/096,846, filed Apr. 1, 2005 in the name of John J. Murphy and entitled INTERLOCKING STORAGE UNITS, now U.S. Pat. No. 7,748,554, which application is based on and claims priority to U.S. Provisional Application No. 60/559,352, filed on Apr. 2, 2004, by John J. Murphy, entitled, "Medication Container Unit," the contents of which are herein incorporated by reference.

BACKGROUND OF THE INVENTION

1. Field of the Invention

The present invention relates generally to containers, and in particular, to a container comprising a plurality of storage units that can be individually detached and then reattached in an interlocking form.

2. Description of Related Art

Pill cases for maintaining and dispensing daily medications, such as pills (which includes, pills, vitamins, capsules or the like) are known. Such pill cases comprise, for example, a unitary box with seven attached compartments, each compartment corresponding to a different day of the week. A small lid typically covers each compartment to retain any pills placed in that compartment. At the beginning of the week, for example, a user (e.g., a patient) of such pill cases may fill each compartment with the corresponding day's medication. Thereafter, on each day of the week, the user retrieves from a corresponding compartment that day's medication. As can be seen, such prior pill cases have the specific purpose of maintaining and dispensing medications.

Notably, however, such prior pill cases have several drawbacks. For example, it is often important that a user stays on a prescribed medication schedule, or in other words, remains compliant with a prescribed medication schedule. However, prior pill cases are relatively large and bulky. As such, it is undesirable and difficult for a user to take such pill cases to work or on short trips because the cases typically will not easily fit within one's pocket or purse. In addition, because of the size of prior pill cases, it is difficult for a user to be discrete when taking medication. As a result, a user is generally reluctant to take such cases to work or on short trips, thereby missing doses. As such, prior pill cases can often cause a user to not remain compliant with a prescribed medication schedule.

Another problem with prior pill cases is that because they do hold a week's medication, it can be very costly if such cases are lost. Accordingly, the possibility of losing such cases may also increase one's reluctance to take these cases to work or on short trips, again, hurting compliance.

SUMMARY OF THE INVENTION

Accordingly, it is desirable to provide a modular container that provides an easier way for users to carry items, like medication, as they travel, thereby overcoming the above and other disadvantages of the prior art. According to an example embodiment of the present invention, a unified container comprises a plurality of individual storage units. Each storage unit comprises at least one compartment and at least one corresponding lid for sealing that compartment. More significantly, each storage unit comprises a releasable interlocking mechanism, such as a tooth and groove mechanism, snaps, a hook-and-loop mechanism such as Velcro®, or the like.

Through the interlocking mechanism, each storage unit interlocks with one or more other storage units, thereby forming the unified container. However, according to the present invention, the interlocking mechanism of each storage unit also allows each unit to be separated or detached from the other storage units, thereby creating individual storage units. Once detached, each storage unit can then be reattached in an interlocking form, thereby once again forming the fully connected and unified container. However, the storage units do not need to be maintained as a single container or as separate units. Specifically, the storage units can be interlocked, detached, and then reattached in any form, thereby forming groups of two, three, etc. interlocked storage units, the interlocked units forming a unified container that is possibly smaller than the original container.

With respect to the releasable interlocking mechanism, it comprises two complimentary mechanisms where one half of the mechanism interlocks with the other half. Again, such a mechanism can include, for example, a tooth and groove mechanism, snaps, a hook-and-loop mechanism such as Velcro®, etc., although the mechanism used is not specific to the invention. Each storage unit includes, for example, either both halves of the interlocking mechanism or only one half of the interlocking mechanism. In this way, two storage units are interlocked by matching corresponding halves of the interlocking mechanism from each unit, thereby forming a unified container.

According to one example embodiment of the present invention, the interlocking mechanism is a tooth and groove mechanism (which can alternatively be referred to as a tongue and groove mechanism). Here, one half of the mechanism is a pair of teeth with corresponding grooves and the other half of the mechanism is a complimentary pair of teeth with corresponding grooves. To interlock two storage units, the teeth from one half of the mechanism from one unit are matched with the grooves from the second half of the mechanism from the other unit, and vise versa. The teeth and grooves are then slid together. Again, this tooth and groove interlocking mechanism is not specific to the invention and any mechanism known in the art that can interlock two storage units can be used.

Overall, the number of storage units comprising a given container is not specific to the invention and the number of compartments per storage unit is not specific to the invention (e.g., each storage unit can include one, two, or more compartments). In addition, the size and shape of each storage unit/compartment(s) is not specific to the invention. Furthermore, each storage unit need not be identical for a given container, with some storage units having more compartments than other storage units and/or being different sizes than other storage units.

According to one example application of the present invention, the container is a pill case where the individual storage units each maintain, for example, medication such as pills. Here, the container/pill case may comprise for example, seven storage units, one for each day of the week. Each storage unit may comprise two compartments, for example, each sized to hold a half day's medication and with one compartment corresponding to morning medication and the other compartment corresponding to evening medication, for example.

In general, a pill case according to the present invention provides a convenient way to keep, maintain, and dispense medications. For example, at the beginning of the week, a user of the pill case may interlock the storage units and fill each compartment of a given storage unit with a corresponding day's medication, the morning medication being placed in one compartment and the evening medication being placed in the other, for example. Notably, if a user only takes medication on certain days of the week, the storage units corresponding to these days can be assemble into a single unified container, and the other units placed aside, thereby reducing the size of the container. Once the storage units are filled, as each day comes, the user may retrieve from a corresponding storage unit that day's medication.

Furthermore, a pill case according to the present invention also helps a user comply with a prescribed medication schedule by reminding the user to take daily medication and by helping the user not to over-medicate given that once medication is taken, the corresponding compartment is empty. However, a pill case according to the present invention also helps to improve compliance with a prescribed medication schedule. More specifically, as a user takes a given day's medication, the corresponding storage unit can be detached, thereby reducing the size of the pill case and making the case easier to carry as one works or travels. Similarly, if a user takes medication only on certain days of the week, as indicated above, those corresponding storage units can be assemble into a single unit, again, reducing the size of the case and making it easier to carry. Overall, because the pill case can be reduced in size, a user is more likely to carry the case during travels and thereby more likely to remain compliant with a given medication schedule.

More importantly, however, the present invention also allows a user to detach one or more storage unit(s) from the pill case and thereby carry only the needed medication to work or on travel. Notably, the individual storage units are smaller than prior pill cases and thereby fit more easily into one's pocket or purse, improving convenience. In addition, the smaller storage units are more discrete than prior pill cases. As a result, a user is more likely to carry the individual storage units when traveling and thereby more likely to remain compliant with a given medication schedule. Overall, note that the present invention is not limited to this single application.

Other features and advantages of the present invention will become apparent from the following description of the invention, which refers to the accompanying drawings.

BRIEF DESCRIPTION OF THE DRAWINGS

FIG. 5A illustrates a top down view of a plurality of example storage units and corresponding example interlocking mechanisms according to an example embodiment of the present invention, the interlocking mechanisms allowing for the plurality of storage units to be individually detached and reattached in an interlocking unified form;

DETAILED DESCRIPTION OF THE PREFERRED EMBODIMENTS

Figure 1:
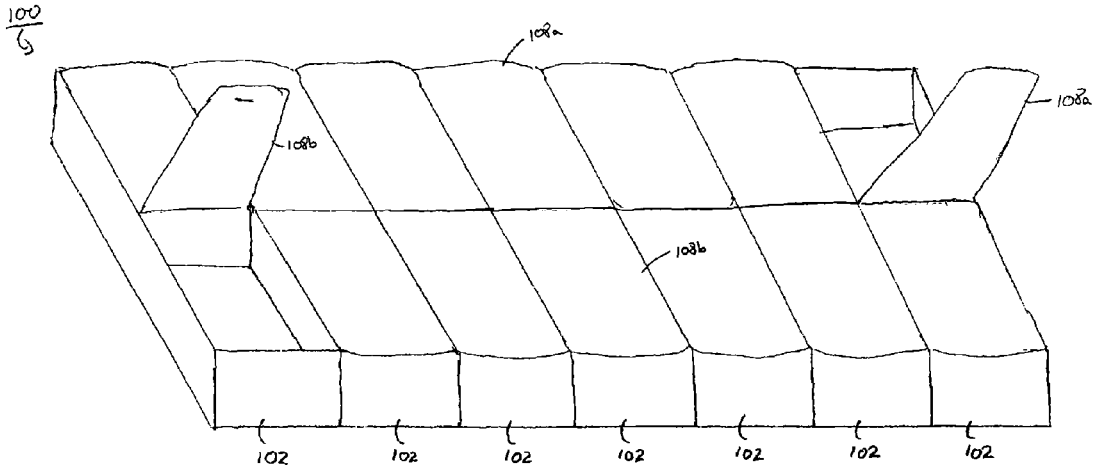
FIG. 1 illustrates an example container according to an example embodiment of the present invention, the container comprising a plurality of detachable and re-attachable storage units, the storage units being illustrated in an attached/interlocked form.
Figure 2:
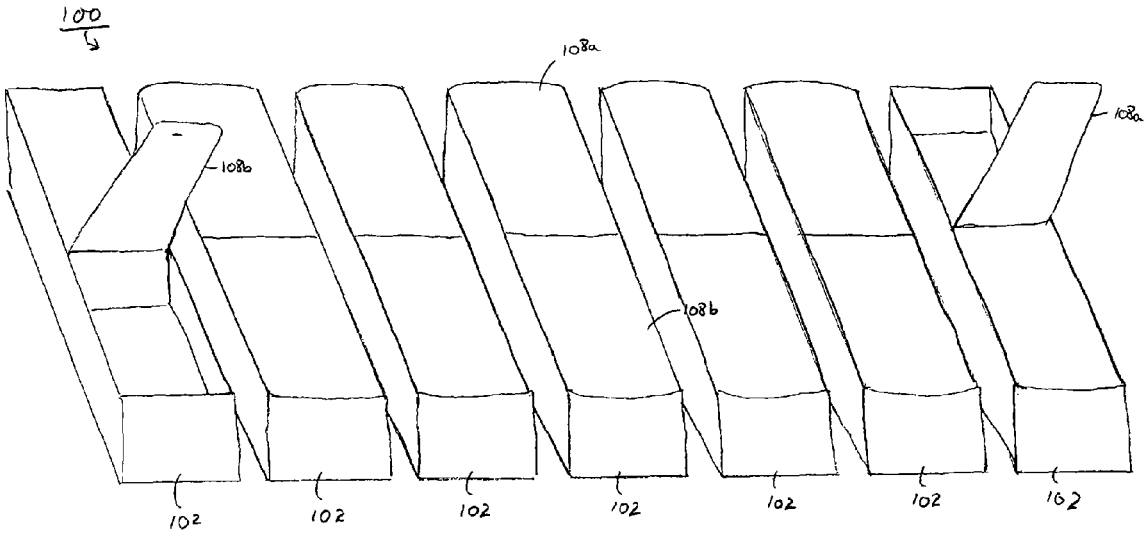
FIG. 2 illustrates the container of FIG. 1 with the plurality of storage units illustrated in a detached form.

Referring to FIG. 1, there is illustrated an example container 100 according to an example embodiment of the present invention. Container 100 comprises a plurality of individual storage units 102 (two of the units are shown with open lids) that are interlocked with one another. Significantly, according to the present invention, each storage unit can be detached from each of its immediate adjacent storage units. As such, container 100 can be separated or detached into a plurality of individual storage units, as illustrated in FIG. 2, for example. As significant, once detached, the individual storage units can then be reattached in an interlocking form, thereby once again forming a fully connected and unified container 100 as illustrated in FIG. 1. However, according to the present invention, the storage units do not need to be maintained as individual units (as illustrated in FIG. 2) or as a single unified container 100 (as illustrated in FIG. 1). More specifically, the storage units can be interlocked, detached, an then reattached in any form, thereby forming groups of two, three, etc. interlocked storage units, the interlocked units thereby forming a unified container that is possibly smaller than container 100. Note that while container 100 is illustrated in FIGS. 1 and 2 as comprising seven storage units 102, the number of storage units is not specific to the invention and container 100 may comprise more than or fewer than seven storage units.

Figure 3A:
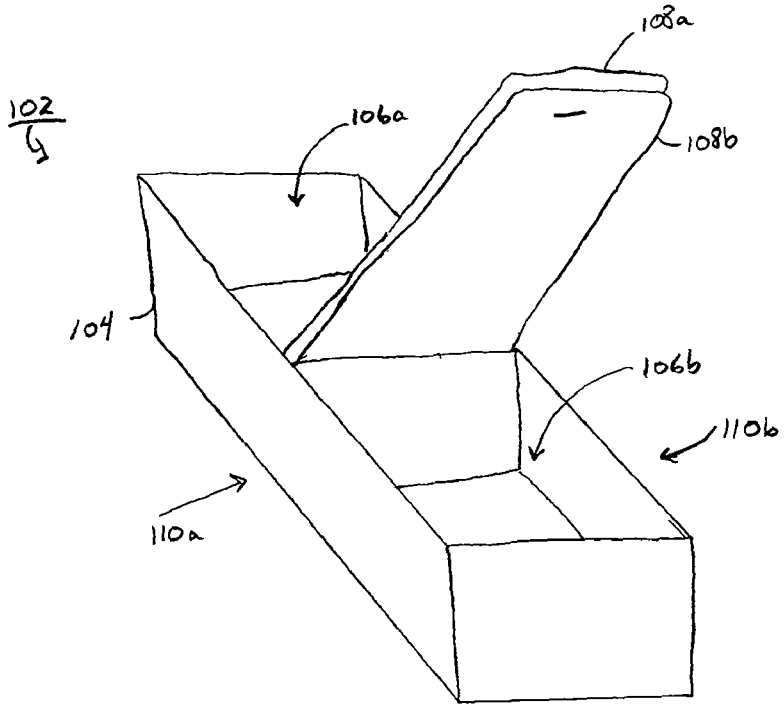
FIGS. 3A and 3B illustrate a perspective view and side view, respectively, of an example storage unit with lids according to an example embodiment of the present invention.
Figure 3B:
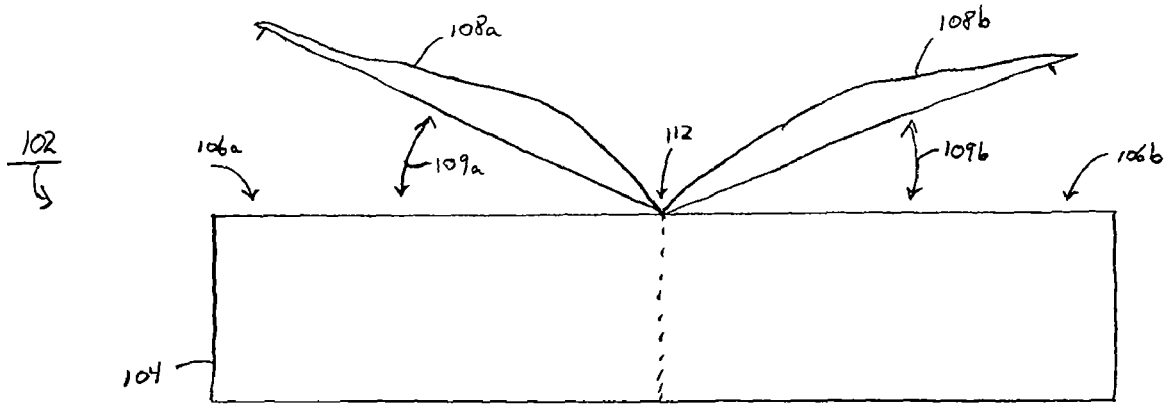

Referring now to FIGS. 3A and 3B, an example storage unit 102 according to an example embodiment of the present invention is shown in further detail, with FIG. 3A showing a perspective view of the storage unit and FIG. 3B showing a side view. As illustrated, each storage unit 102 comprises a main body 104 shaped to form two separate compartments 106*a* and 106*b*, each of which is accessible from the top side of the main body. Each storage unit also comprises two operable lids 108*a* and 108*b*, each lid corresponding, respectively, to compartments 106*a* and 106*b*. Each lid 108*a* and 108*b* is situated along the top side of main body 104 and provides a mechanism for sealing/closing each compartment 106*a* and 106*b*. Each storage unit further comprises a releasable interlocking mechanism directed at sidewalls 110*a* and 110*b* of main body 104 (the interlocking mechanism is not shown in FIGS. 3A and 3B), this mechanism allowing each storage unit to connect to (or interlock with) and detach from its adjacent storage units. More specifically, the interlocking mechanism comprises two complimentary components, such as a tooth and groove mechanism, snaps, a hook-and-loop mechanism such as Velcro®, or any other releasable mechanism known in the art. Accordingly, one half of the complimentary interlocking mechanism is directed at sidewall 110*a* of main body 104 and the other half of the complimentary interlocking mechanism is directed at sidewall 110*b*. In this way, two storage units are interconnected/interlocked, for example, by interlocking sidewall 110*a* of one unit to sidewall 110*b* of a second unit through complimentary halves of the interlocking mechanism, with each storage unit providing one half of the complimentary mechanism. Once interlocked, the two storage units form a unified container. Significantly, however, the two storage units can also be disconnected by detaching the complimentary halves of the interlocking mechanism.

Accordingly, example container 100 of the present invention comprises a plurality of storage units 102, each of which comprises two compartments with corresponding lids and each of which further comprises an interlocking mechanism directed towards its sidewalls that allows for the interconnection, detachment, and re-attachment of adjacent storage units. As such, according to one example application of the present invention, container 100 is a pill case where each storage unit stores or maintains, for example, medication such as pills (which includes, pills, vitamins, capsules or the like) within the individual compartments 106*a* and 106*b*. According to this example application, container 100 may comprise, for example, a total of seven storage units 102, one for each day of the week, with each storage unit holding in each of its two compartments, for example, morning and evening medication. As such, each of compartments 106*a* and 106*b* are of a size, for example, to hold a half day's medication. For example, each compartment 106*a* and 106*b* can be sized to hold approximately twenty aspirin size pills. According to the present invention, as a user of container 100 goes to work or travels from home, for example, the user can simply detach those storage units that are needed while away, thereby reducing the size of container 100 and simplifying travel. Thereafter, these storage units can be reattached to container 100 and reused, thereby one again forming a unified container.

However, it should be noted that the present invention is not limited to this single application and the invention can by applied to any application that requires compartmentalized storage. Accordingly, example container 100 of the present invention may comprise more than or fewer than seven storage units, as indicated above, with the size of compartments 106*a* and 106*b* configured for the given application. As such, each storage unit can be used to hold various items, such as different color paints or various sized screws or nails, for example. When the storage units are interlocked into a single unified container 100, the invention provides a convenient way to organize and maintain the items. However, if a user needs only one or two items, for example, rather than carry the entire container 100 to a given location, the corresponding storage unit(s) can be detached and taken with the user, thereby reducing the overall size of container 100.

Turning now to a more detailed description of each example storage unit 102, main body 104 and lids 108*a* and 108*b* may be made of plastic, metal, or any other suitable material known in the art. As further described below, the main body and lids may be one integral unit or alternatively, may be separate units that are operably interconnected. Accordingly, the lids and main body may be made of the same material or from different materials. For example, the main body can be made of plastic while the lids are made of metal. As indicated above and as further described below, one example interlocking mechanism is a tooth and groove mechanism. Here, the tooth and groove may be integral with main body 104 and thereby made of the same material as the main body.

Turning to compartments 106*a* and 106*b*, as illustrated in FIGS. 3A and 3B, each compartment is separate from the other. Note that in FIGS. 1, 2, 3A and 3B, each compartment, and thereby main body 104, is illustrated as having a rectangular shape, thereby giving container 100 a rectangular shape when storage units 102 are interconnected into a single unified module. Nonetheless, note that the specific shape of compartments 106*a-b*/main body 104 and thereby container 100 is not specific to the present invention and the compartments, main body, and container may have any shape. For example, main body 104 of each storage unit 102 may have a wedge-like shape and be subdivided, for example, into two wedge-shaped compartments. In this fashion, when the storage units are interconnected, container 100 would have a circular shape, for example. Similarly, rather than main body 104 having distinct outer edges as illustrated in FIGS. 1, 2, 3A and 3B, the outer edges may be somewhat rounded, thereby giving each storage unit and thereby container 100 a more contemporary appearance. Furthermore, note that while FIGS. 1, 2, 3A and 3B illustrate the compartments 106*a* and 106*b* of a given storage unit as abutting back-to-back, this arrangement is not specific to the invention. Hence, each storage unit may comprise two compartments that are side-by-side or two compartments that are situated one on top of the other such that one compartment is accessed from the top side of the storage unit and the other compartment is accessed from the bottom side of the storage unit, etc.

In addition to the shape and configuration of each compartment 106*a* and 106*b* not being specific to the invention, note that the overall size and depth of each compartment is also not specific to the present invention. Accordingly, if container 100 is a pill case, for example, each compartment may have a size and shape to hold/maintain a plurality of pills for at least a half-day's dose of medication, the two compartments together thereby holding, for example, a full day's does of medication. However, if container 100 is being applied to a different application to hold items other than medication, each compartment 106*a* and 106*b* may have a larger or smaller size.

Turning next to lids 108*a* and 108*b* of example storage unit 102, as indicated, each lid corresponds, respectively, to compartments 106*a* and 106*b* and provides a mechanism for sealing/closing each compartment. As illustrated in FIGS. 3A and 3B, each lid of example storage unit 102 is attached to the top side of main body 104 at point 112 such that each lid closes and opens towards and away from the top side of the main body in a hinge-like fashion, as shown by arrows 109*a* and 109*b*. Notably, each lid includes a locking mechanism such that when the lid is moved to the closed position, the lid remains flush with the main body, thereby sealing the contents of the corresponding compartment and preventing the contents from falling out when the storage unit is moved. Similarly, this locking mechanism allows the lid to be re-opened with the exertion of a minor force by a user. Note that although FIGS. 3A and 3B illustrate lids 108 and 108*b* as being attached to main body 104 at a central point 112 such that the two lids open towards the center of the main body in a hinge-like fashion, this orientation is not specific to the invention. Specifically, the two lids can be attached to any point along the main body and can open and close in a hinge-like fashion either towards the same point or towards different points.

Figure 4A:
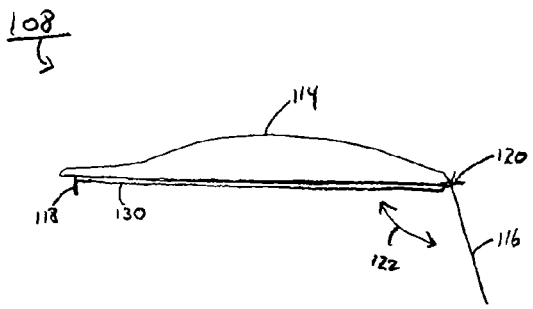
FIGS. 4A and 4B illustrate a side view and bottom/underside view, respectively, of an example lid according to an example embodiment of the present invention.
Figure 4B:
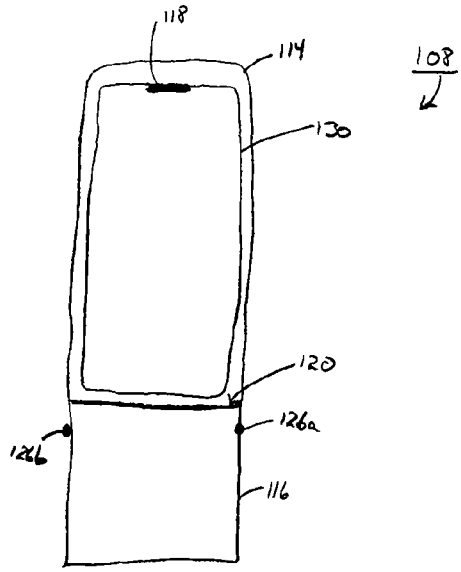

Referring now to FIGS. 4A and 4B, there is illustrated in further detail an example lid 108 of example storage unit 102, FIG. 4A showing a side view of the example lid and FIG. 4B showing an underside view of the lid. As illustrated, example lid 108 is an integral unit made of plastic, for example, comprising covering 114, tab 116, and locking tab 118. At the connection between covering 114 and tab 116 there is crease 120 that allows covering 114 to move relative to tab 116 in a hinge-like fashion, as illustrated by arrow 122. Locking tab 118 is a small tab integrally attached to the underside of covering 114 at the end opposite to that of tab 116. As illustrated, locking tab 118 extends perpendicularly downward from the underside of the covering.

Figure 4C:
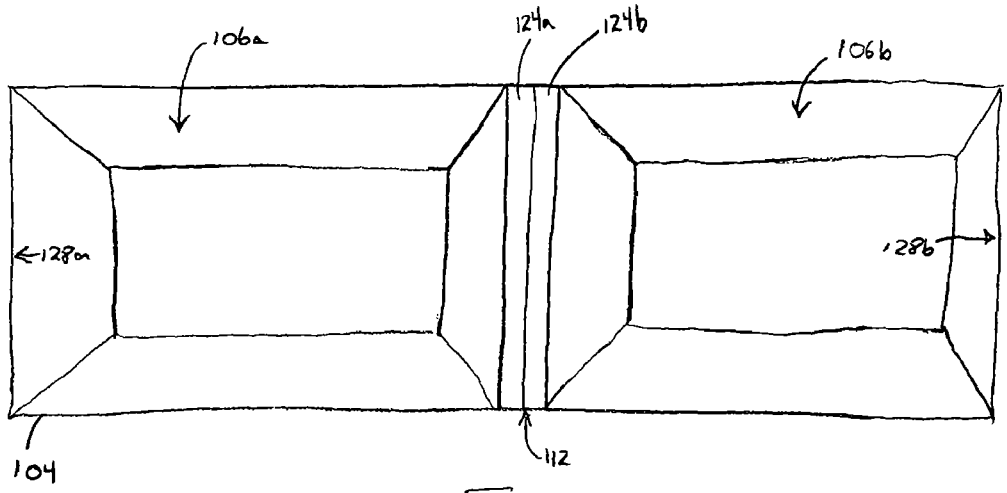
FIG. 4C illustrates a top-down view of an example storage unit according to an example embodiment of the present invention, the unit here having the lids removed.
Figure 4D:
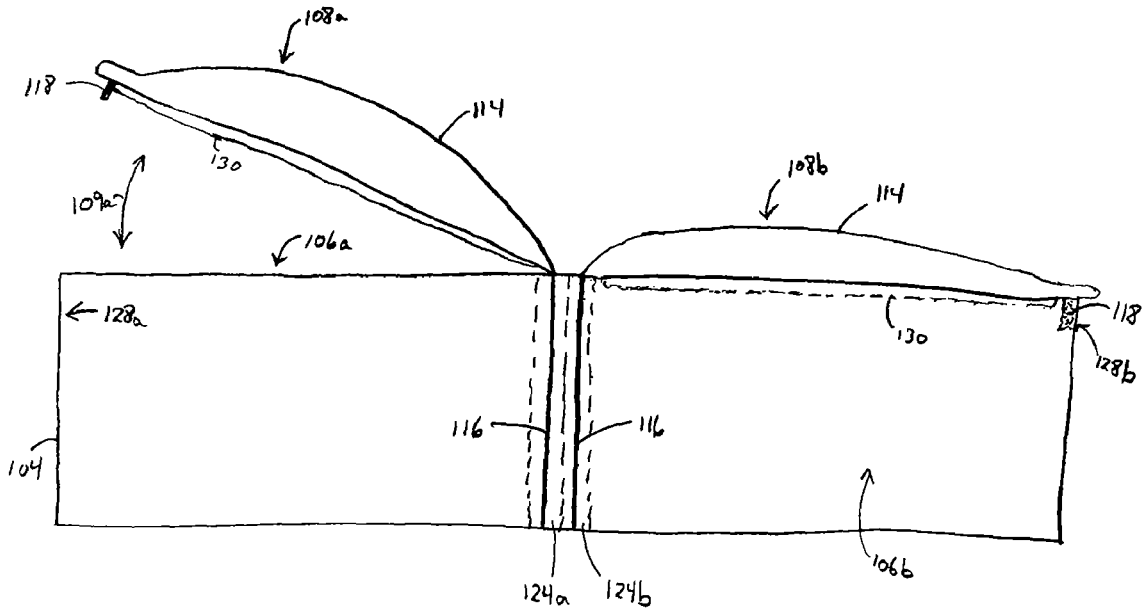
FIG. 4D illustrates the interconnection of the example lid of FIGS. 4A and 4B with the example storage unit of FIG. 4C, with FIG. 4D showing a side view of the storage unit and lids.

Referring now to FIGS. 4C and 4D, there is illustrated in further detail an example mechanism for interconnecting example lid 108 of FIGS. 4A and 4B to main body 104 of example storage unit 102. Specifically, FIG. 4C illustrates a top down view of main body 104 with the lids removed and FIG. 4D illustrates a side view of the main body and in particular, the interconnection of example lid 108 of FIGS. 4A and 4B to the main body. In this example and as illustrated in FIGS. 4C and 4D, main body 104 includes two slots 124*a* and 124*b* in addition to compartments 106*a* and 106*b*, the two slots being situated towards central point 112 of the main body. Each slot 124*a* and 124*b* corresponds to one of the two lids 108*a* and 108*b*. To assemble the example lids to the main body, tab 116 of each lid is inserted into a slot 124*a* or 124*b*, as illustrated in FIG. 4D, such that cover 114 extends above the top side of the main body. In this example, each tab 116 includes small protrusions 126*a* and 126*b* along its sides (as illustrated in FIG. 4B) such that when the tab is inserted into its corresponding slot 124*a/b*, the protrusions exert pressure against the walls of the slot, thereby maintaining tab 116 in place. In this fashion, cover 114 moves in a hinge-like fashion between an open and closed position relative to the surface of the main body, thereby sealing or exposing its corresponding compartment.

Regarding locking tab 118, when the cover is moved to the closed position and depressed downward with minor force, the locking mechanism engages and exerts pressure against the inner surface of the front wall of the compartment at point 128*a* or 128*b*, the pressure thereby maintaining the cover in a closed position (see, for example, lid 108*b* in FIG. 4D). Similarly, through the exertion of a minor upward force, the locking mechanism disengages the front wall, thereby allowing the cover to open.

According to a further aspect of the present invention, each lid 108*a* and 108*b* creates an air tight seal with main body 104 when the lid is moved to the closed position. Such a seal helps to keep the contents of the compartments dry, for example, from humidity and moisture. Notably, any mechanism known in the art for achieving an air tight seal can be used. In the example lid of FIGS. 4A and 4B, the lid further comprises a ridge 130 on the underside of cover 114, which ridge extends perpendicularly downward from the cover and has a shape corresponding to the shape of compartments 106*a* and 106*b*. Here, when the cover is moved to the closed position and depressed downward over a compartment, ridge 130 engages the complete perimeter of the inner wall of the compartment, as illustrated in FIG. 4D, thereby creating a seal.

Again, the example lid of FIGS. 4A, 4B, 4C, and 4D is only one example of a hinge-type lid with a locking mechanism and seal and is not specific to the present invention. Overall, any mechanism known in the art for providing lids that move in a hinge-like fashion relative to main body 104 can be used. Furthermore, note that lids 108*a* and 108*b* and main body 104 do not need to be separate modules. Specifically, if the main body and lids are made of plastic, for example, the lids and main body can be one integral unit, with the connection between each lid and the main body being a crease, for example, to provide hinge-like movement. In addition, any mechanism known in the art for ensuring the lids remain in a closed position can be used. For example, the locking mechanism 118 in the above example can engage and exert pressure against the outer surface of the front wall of the compartment, rather than the inner surface. Similarly, a spring type mechanism can be used that naturally moves the lid to either the open or closed position, etc.

It should also be noted that the two lids 108*a* and 108*b* of example storage unit 102 are only one example closure mechanism for sealing/closing compartments 106*a* and 106*b* and the invention can be expanded to include any other type of closure mechanism known in the art. For example, rather than using two separate lids, one for each compartment, a single lid that moves in a hinge-like fashion can be used to cover both compartments. Similarly, rather than using lids that move in a hinge-like fashion, one or more slide-tabs can be used. For example, each compartment 106*a* and 106*b* can have a corresponding slide-tab that moves/slides within the plane of the top surface of the main body. Here, sliding the slide-tab in one direction exposes the compartment while sliding the slide-tab in the opposite direction closes the compartment.

Referring now to the releasable interlocking mechanism of each storage unit 102, as indicated, this mechanism allows each storage unit to connect/interlock with and detach from each of its adjacent storage units. Again, the interlocking mechanism comprises two complimentary mechanisms, one half of the complimentary mechanism, for example, being directed at sidewall 110*a* of main body 104 and the other half of the complimentary mechanism being directed at sidewall 110*b*. In this way, sidewall 110*a* of one storage unit is brought together with sidewall 110*b* of a second storage unit and interlocked through complimentary halves of the interlocking mechanism, thereby forming a unified container that allows the two storage units to be moved as one. More specifically, referring to FIGS. 5A and 5B there is illustrated an example interlocking mechanism 140 of an example storage unit 102 of the present invention. Note that FIGS. 5A and 5B are both top down views of example container 100 and example storage units 102 and in each case, lids 108*a* and 108*b* are removed for clarity, thereby exposing compartments 106*a* and 106*b*.

Figure 5B:
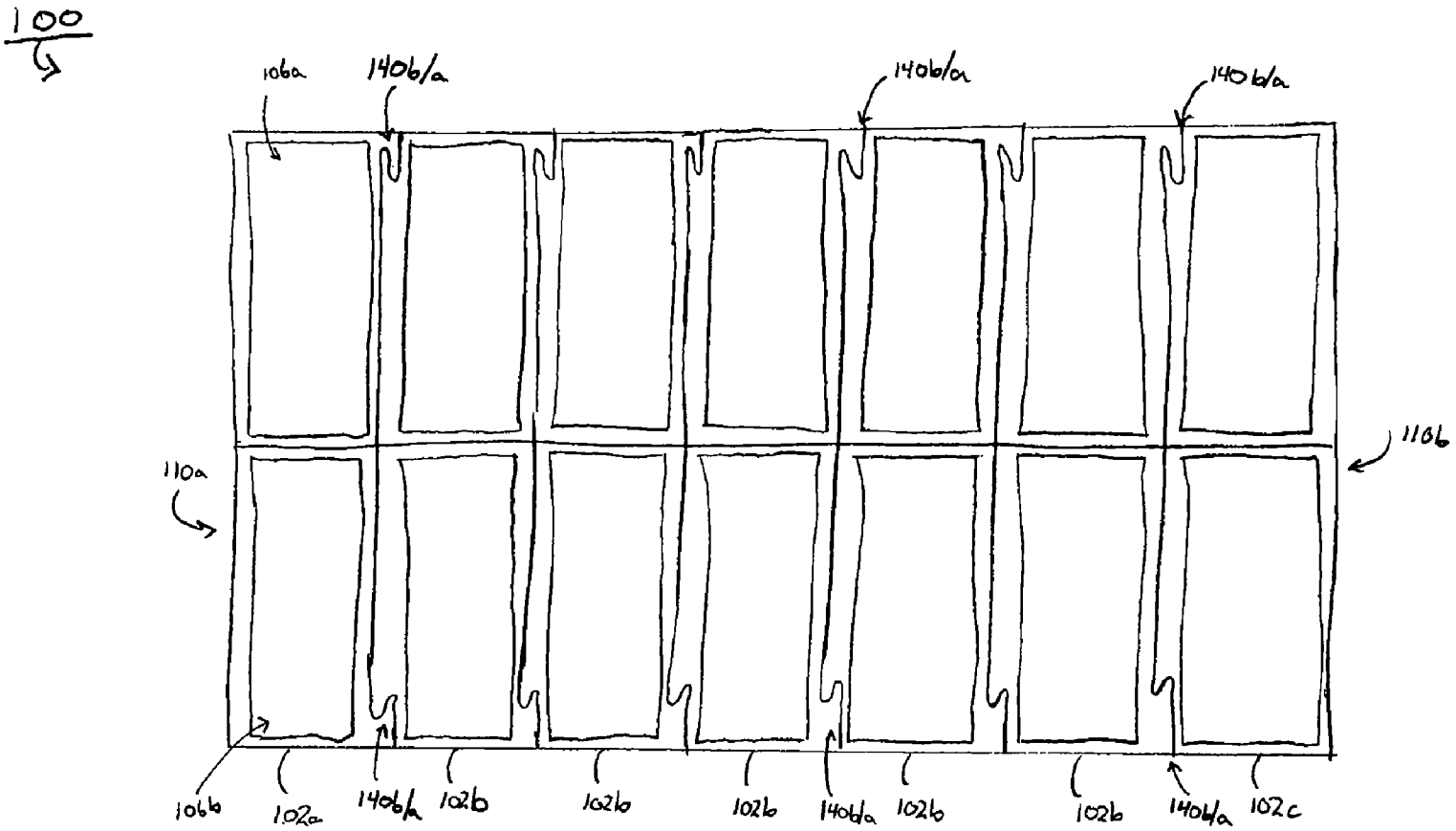
FIG. 5B illustrates a top down view of the plurality of storage units of FIG. 5A in an interlocked form, thereby creating a single unified container.

Beginning with FIG. 5A, storage units 102 are shown in their disconnected/detached form. Note that in this Figure (as well as FIG. 5B), the storage units are further designated as 102*a*, 102*b*, or 102*c*, with storage units 102*a* and 102*c* designating end storage units of container 100 and storage units 102*b* designating inner storage units. As illustrated in FIG. 5A, example interlocking mechanism 140 comprises two complimentary components, 140*a* and 140*b*. Component 140*a* is a tooth and groove mechanism directed along sidewall 110*a* of the main body of storage units 102*b* and 102*c* and component 140*b* is a complimentary tooth and groove mechanism directed along sidewall 110*b* of the main body of storage units 102*a* and 102*b* (note that complimentary components 140*a* and 140*b* can also be referred to as a tongue and groove mechanism). Note that the two end storage units, 102*a* and 102*c*, of example container 100 each only includes one half of interlocking mechanism 140, as just indicated. Sidewall 110*a* of storage unit 102*a* and sidewall 110*b* of storage unit 102*c* are smooth. In this way, when all storage units are interconnected to form unified container 100, as illustrated in FIG. 5B for example, the outer sides of container 100 are smooth and thereby aesthetically pleasing. Nonetheless, note that all of the storage units 102*a*, 102*b*, and 102*c* comprising container 100 can be identical such that all storage units include both components 140*a* and 140*b*.

As illustrated in FIG. 5A, components 140*a* and 140*b* of interlocking mechanism 140 are of a complimentary form, as indicated, such that the tooth and groove mechanism of component 140*a* matches up with and can interlock with the tooth and groove mechanism of component 140*b*. More specifically, to interconnect the storage units 102, the sidewall 110*a* of one unit is paired with sidewall 110*b* of a second unit. In this way, each storage unit contributes one half (either component 140*a* or 140*b*) of interlocking mechanism 140. Component 140*a* of one unit is then interlocked with component 140*b* of the other unit. When this process is repeated across all units for example, unitary or unified container 100 is formed, as illustrated in FIG. 5B. Similarly, component 140*a* of one storage unit can be detached from component 140*b* of a second storage unit. Again, this detachment can be performed for all storage units 102, resulting in individual storage units as illustrated in FIG. 5A. However, again, note that the storage units of the present invention can be interlocked and detached in any form, thereby forming groups of two, three, etc. storage units interlocked to form a unified container that is possibly smaller than container 100.

Figure 5C:
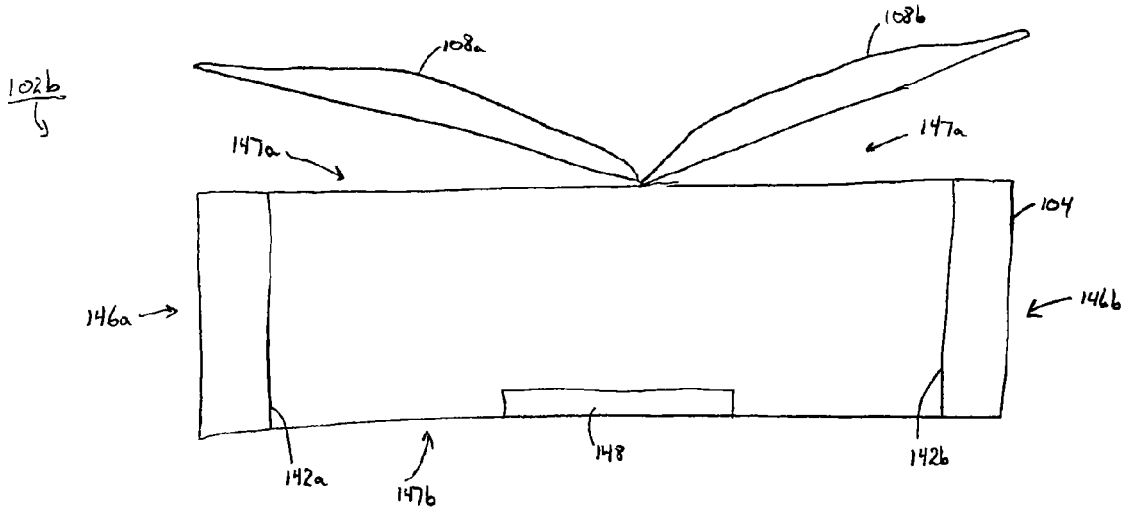
FIGS. 5C, 5D, and 5E illustrate a side view, a bottom view, and an alternate side view, respectively, of a storage unit and interlocking mechanism from FIG. 5A.

Reference will now be made in greater detail to components 140*a* and 140*b* of example interlocking mechanism 140. Beginning with component 140*a* and referring to FIG. 5A (in particular, the center storage unit), to FIG. 5C, which is a side view of a storage unit 102*b* showing sidewall 110*a*, and to FIG. 5D, which is a bottom view of a storage unit 102*b*, component 140*a* comprises two outer teeth 142*a* and 142*b*, each configured to form a corresponding outer groove, 143*a* and 143*b*, respectively. Notably, component 140*a* also comprises stop notch 148 (see FIGS. 5C and 5D), although this notch is not required. Outer teeth 142*a* and 142*b* each extends from the top-side 147*a* to the bottom side 147*b* of main body 104. Tooth 142*a* projects or is directed towards the top end 146*a* of the main body, thereby forming outer groove 143*a* and tooth 142*b* projects or is directed towards the bottom end 146*b* of the main body, thereby forming outer groove 143*b*. As illustrated, outer grooves 143*a* and 143*b* also extend from the top side 147*a* to the bottom side 147*b* of the main body 104. Notably, teeth 142*a-b* and grooves 143*a-b* do not need to extend the full height of the storage unit and again, interlocking mechanism 140 is simply one example of a tooth and groove type mechanism. When included, stop notch 148 is a recess formed along an edge of bottom side 147*b* of main body 104.

Figure 5D:
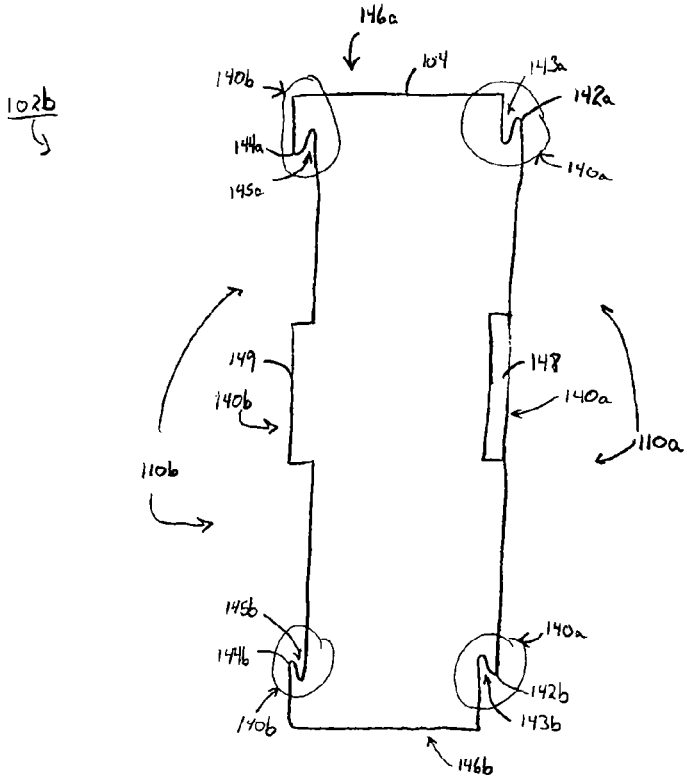
Figure 5E:
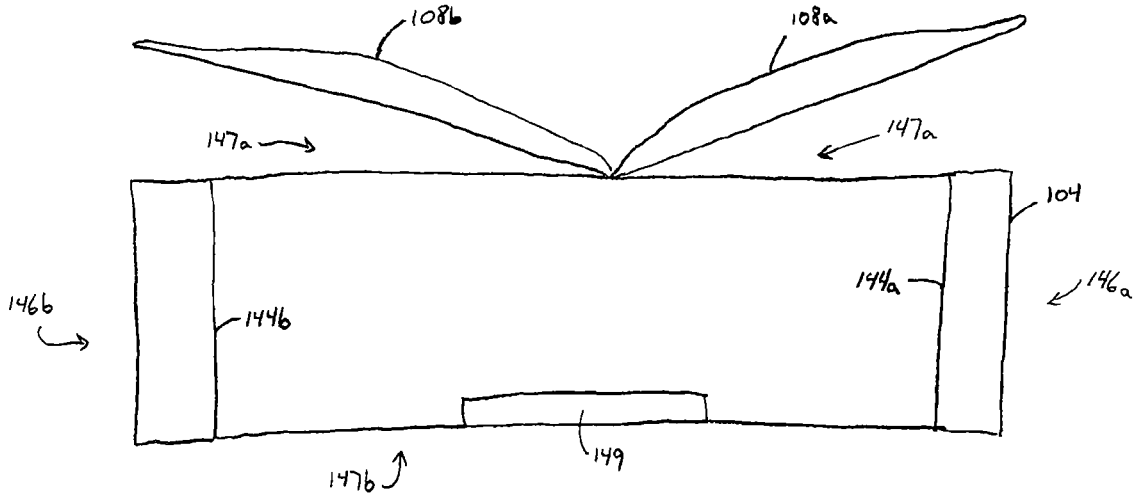

Turning now to component 140*b* and referring to FIG. 5A (in particular, the center storage unit), to FIG. 5D, and to FIG. 5E, which is a side view of a storage unit 120*b* showing sidewall 110*b*, component 140*b* comprises two inner teeth 144*a* and 144*b*, each configured to form a corresponding inner groove, 145*a* and 145*b*. Notably, component 140*b* also comprises stop guard 149 to compliment stop notch 148, although again, this guard is not required. Similar to outer teeth 142*a* and 142*b*, inner teeth 144*a* and 144*b* each extends from the top side 147*a* to the bottom side 147*b* of main body 104, although they do not need to. Tooth 144*a* projects inward away from the top end 146*a* of the main body, thereby forming inner groove 145*a* and tooth 144*b* projects inward away from bottom end 146*b* of the main body, thereby forming inner groove 145*b*. As illustrated, inner grooves 145*a* and 145*b* also extend from the top side 147*a* to the bottom side 147*b* of main body 104. When included, stop guard 149 is a tab formed along an edge of bottom side 147*b* (opposite stop notch 148) of main body 104 and extends perpendicularly outward from sidewall 110*b*.

Figure 5F:
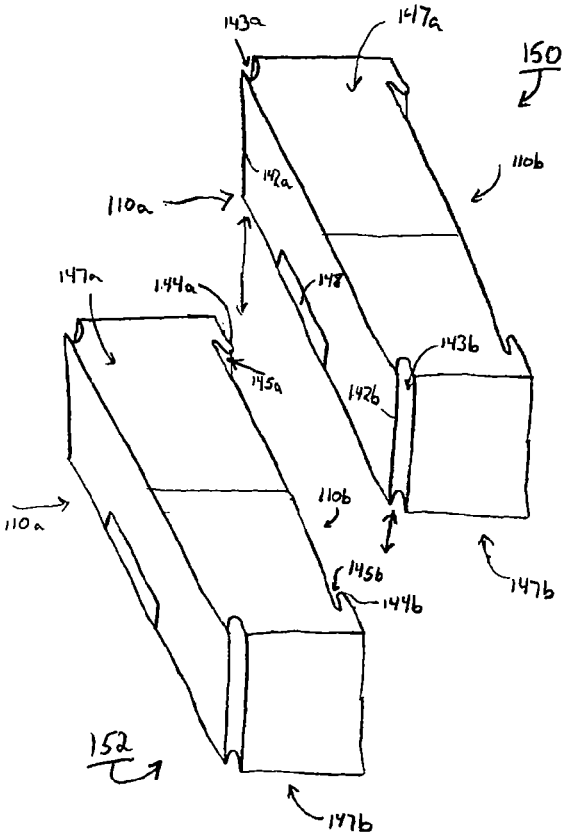
FIGS. 5F and 5G illustrate an example procedure for interlocking two storage units of FIG. 5A according to an example embodiment of the present invention.
Figure 5G:
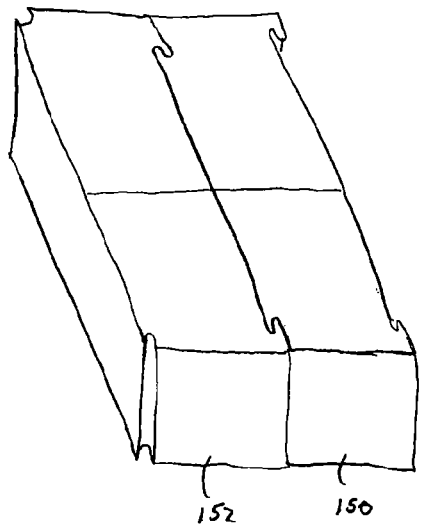

As indicated above, components 140*a* and 140*b* of interlocking mechanism 140 are of a complimentary form such that component 140*a* matches up with and can interlock with component 140*b*. More specifically, referring to FIG. 5F, there is illustrated an example assembly of two storage units using example interlocking mechanism 140. As shown, a first storage unit 150 (if present, this storage unit would have stop notch 148) is held above a second storage unit 152 such that side 110*a* of unit 150 and side 110*b* of unit 152 are directed at each other. The outer grooves 143*a* and 143*b* of storage unit 150 are then aligned with inner teeth 144*a* and 144*b*, respectively, of storage unit 152 and inner grooves 145*a* and 145*b* of storage unit 152 are aligned with outer teeth 142*a* and 142*b*, respectively, of storage unit 150. Once aligned in this fashion, storage unit 150 is pressed or slid downward for example (or units 150 and 152 are slid in opposite directions, for example), with outer grooves 143*a* and 143*b* of storage unit 150 receiving inner teeth 144*a* and 144*b* of storage unit 152 and inner grooves 145*a* and 145*b* of storage unit 152 receiving outer teeth 142*a* and 142*b* of storage unit 150. Storage units 150 and 152 are juxtaposed until top side 147*a* and bottom side 147*b* of each storage unit become flush, with components 140*a* and 140*b* interlocking the two units and creating a unified container, as illustrated in FIG. 5G. Notably, if stop notch 148 and stop guard 149 are included, storage unit 150 is pressed downward until stop notch 148 of storage unit 150 receives stop guard 149 of storage unit 152, thereby preventing the units from moving further and causing top side 147*a* and bottom side 147*b* of the two units to become flush (i.e., the stop guard and stop notch help to automatically align the top and bottom sides of the two storage units). Overall, note that according to example interlocking mechanism 140, the corresponding teeth 142*a-b*/144*a-b* and grooves 143*a-b*/145*a-b* are configured to resistively receive one another, this resistive force thereby holding the adjacent storage units together once in the assemble position and allowing them to be moved as one. Note also that in order to separate the two units, storage unit 150 is pressed upward while storage unit 152 is pulled downward, for example, until the pairs of teeth 142*a-b*/144*a-b* and grooves 143*a-b*/145*a-b* disengage.

Again, interlocking mechanism 140 is only one example mechanism for interlocking adjacent storage units and is not specific to the present invention. Accordingly, any mechanism known in the art can be used to interlock two adjacent storage units. For example, the interlocking mechanism can comprise a different shaped or different type of tooth and groove mechanism (and notch and guard mechanism) than that described above in reference to FIGS. 5A-5G. Alternatively, a snap-based mechanism or a loop and hook based mechanism, like Velcro®, can be used. Here, one half of the snap or Velcro®, for example, would be situated on sidewall 110*a* and the other half situated on sidewall 110*b*, for example. As another example, tab(s) may extend perpendicularly outward from sidewall 110*a* while sidewall 110*b* has corresponding slots to receive the tabs. In this way, two storage units are interlocked by holding sidewall 110*a* of one unit adjacent to sidewall 110*b* of the other unit and then pressing the two units together.

As indicated above, one example application of the present invention and container 100 is a pill case where the storage units 102 each stores or maintains, for example, medication such as pills within the individual compartments 106*a* and 106*b*. According to this example application, container 100 may comprise, for example, seven storage units 102, one for each day of the week. According to one aspect of this example application, the lids 108*a* and 108*b* of each storage unit may have a designation (e.g., "SUN", "MON", "TUES", "WED", "THUR", "FRI', or "SAT") for a respective day of the week, with each storage unit having a different designation and with each lid of a given storage unit having the same designation. According to another aspect of this example application, one of the two compartments 106*a* and 106*b* of a given storage unit may correspond to morning medication while the other corresponds to evening medication. Here, one lid may have a morning designation (e.g., "AM") while the other lid may have an evening designation (e.g., "PM"). Alternatively or in addition, the two lids of each storage unit may be a different color with one color designating morning medication and the other color designating evening medication, for example. According to a still further aspect of this example application, in addition to word designations (i.e., "SUN", "MON", "AM", "PM), Braille markings may alternatively or additionally be used.

Similar to prior pill cases, at the beginning of the week, for example, a user of container 100 (i.e., pill case) may fill each compartment of a given storage unit with a corresponding day's medication, the AM medication being placed in one compartment and the PM medication being placed in the other, for example. Notably, if the user only takes medication once a day, one of the two compartments may not be used. In general, a user may first interlock the storage units into a unified container 100, for example, and then fill the storage units or, alternatively, fill the storage units and then interlock the units into a unified container 100, etc. Note also that if a user only takes medication on certain days of the week, the storage units corresponding to these days can be assemble into a single unified container, and the other units placed aside, thereby reducing the size of container 100. In general, once the storage units are filled, as each day comes, the user may retrieve from a corresponding storage unit that day's medication. Accordingly, container 100 provides a convenient way to keep, maintain, and dispense medications.

Furthermore, container 100 also helps a user comply with a prescribed medication schedule by reminding a user to take daily medication and by helping the user to not over-medicate given that once medication is taken, the corresponding compartment is empty. However, unlike prior pill cases, container 100 of the present invention also helps to improve compliance with a prescribed medication schedule. More specifically, as a user takes a given day's medication, the corresponding storage unit can be detached, thereby reducing the size of container 100 and making the container easier to carry as one works or travels. Similarly, if a user takes medication only on certain days of the week, as indicated above, those corresponding storage units can be assemble into a single unit, again, reducing the size of container 100 and making it easier to carry. Overall, because container 100 can be reduced in size, a user is more likely to carry the container during travels and thereby more likely to remain compliant with a given medication schedule.

Perhaps more important, however, the present invention also allows a user to detach one or more storage unit(s) from container 100 and thereby carry only the needed medication to work or on travel. Notably, the storage units are smaller than prior pill cases and thereby fit more easily into one's pocket or purse, improving convenience. In addition, the smaller storage units are more discrete than prior pill cases. As a result, a user is more likely to carry the individual storage units during travels and thereby more likely to remain compliant with a given medication schedule.

As important, because a user only needs to carry the needed medication rather than the entire container, it is less costly if a given storage unit is lost. Again, once the storage units have been detached, they can be reattached into a single unit, and thereby reused for the next week. As discussed above, the present invention is not limited to this single application.

Referring now to other embodiments of the present invention, as described above, each storage unit 102 is an integral unit that comprises two compartments 106*a* and 106*b*. According to another example embodiment of the present invention, the compartments 106*a* and 106*b* of each storage unit can be detached and reattached/interlocked using, for example, an interlocking mechanism such as those described above. Accordingly, a user can detach and reattach container 100 on a storage unit basis and/or on a per compartment basis (in essence, according to this example embodiment of the invention, a container 100 essentially comprises numerous storage units each with a single compartment, where each storage unit can interlock with other storage units along several of its sidewalls/bottom). When such a container 100 is applied to a pill case, for example, a user may simply detach a PM compartment, for example, when going to work. According to still another example embodiment of the invention, each storage unit may comprise more than two compartments, again, each compartment having a corresponding lid, for example. Here, the multiple compartments of each storage unit may also be capable of being detached and reattached/interlocked, as just described.

According to another example embodiment of the present invention, each storage unit need not include the same number of compartments or the same sized compartments. Hence, one or more storage units may be subdivided into more compartments than other storage units. Similarly, each storage unit need not have the same dimensions. For example, sidewalls 110*a* and 110*b* of each storage unit may have the same dimension, allowing the storage units to interlock. However, the dimensions of top side 146*a* and bottom side 146*b* between different storage units can vary, thereby making some storage units wider than others, for example.

According to still another example embodiment of the present invention, each storage unit need not interlock with other storage units only along sidewalls 110*a* and 11*b*, as illustrated in FIGS. 1, 2, 5A, and 5B, for example. Specifically, each storage unit may also include, for example, an interlocking mechanism directed at bottom side 147*b*. In this way, storage units can be interlocked side-by-side and back-to-back, for example. Similarly, each storage unit may also include, for example, an interlocking mechanism directed at top end 146*a* and bottom end 146*b*.

Figure 6:
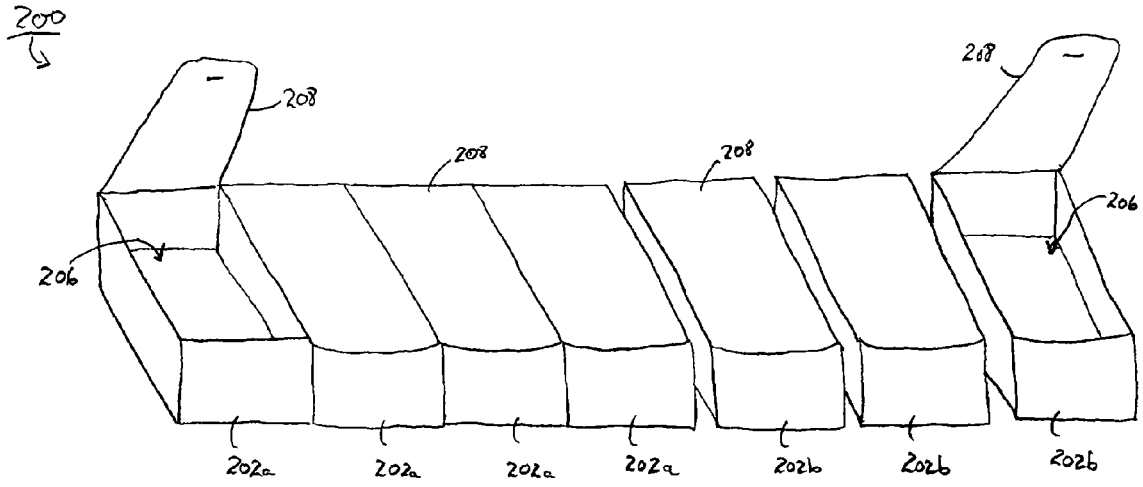
FIG. 6 illustrates an example container according to an example embodiment of the present invention, the container comprising a plurality of detachable and re-attachable storage units, the storage units being illustrated in both an interlocked and detached form.

Referring now to FIG. 6, there is illustrated an example container 200 according to a further example embodiment of the present invention. Container 200 comprises a plurality of storage units 202. Storage units 202 are similar to storage units 102 but now include only one compartment 206 and one lid 208, the compartment and lid being similar to compartment 106*a*/106*b* and lid 108 as described above. Significantly, each storage unit 202 again includes an interlocking mechanism (not shown in FIG. 6) directed at its sidewalls, for example, the interlocking mechanism being similar to any of those described above for storage units 102, for example. Accordingly, each storage unit 202 can be detached from adjacent storage units (as illustrated by storage units 202*b*) and reattached/interlocked (as illustrated by units 202*a*), thereby once again forming unified container 200, or a unified container smaller than container 200.

Again, note that although container 200 is illustrated as having seven storage units 202, this number of storage units is not specific to this embodiment of the invention and container 200 may comprise more than or fewer than seven storage units. In addition, note that while the shapes of compartment 206, storage unit 202, and container 200 are shown as rectangular, this shape is not specific to the invention. Similarly, compartment 206 may be of any size. Furthermore, different storage units may have different sized compartments.

As an example application, container 200 may be a pill case. According to this example application, container 200 may comprise, for example, seven storage units 202, one for each day of the week. Here, each compartment would be configured to have a size, for example, to hold one day's worth of medication. The lid 208 of each storage unit may have, for example, a designation (e.g., "SUN", "MON", "TUES", "WED", "THUR", "FRI', or "SAT") for a respective day of the week, with each storage unit having a different designation.

Figure 7:
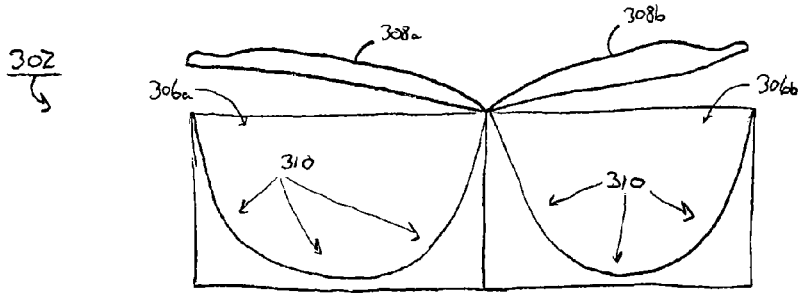
FIG. 7 illustrates a side view of an example storage unit according to an example embodiment of the present invention.

Referring now to FIG. 7, there is illustrated a side view of an example storage unit 302 according to a still further example embodiment of the present invention, the storage unit here comprising two compartments 306*a* and 306*b* each with lids 308*a* and 308*b* (again, this embodiment of the invention is not limited to two compartments and is also applicable, for example, to storage units 202). As indicated above, the exact size and shape of compartments 106*a*/106*b* of storage unit 102 (or compartment 206 of storage unit 202) are not specific to the invention. Nonetheless, the interiors (or, in other words, the bottoms) of these compartments were described and illustrated as being somewhat angular, or in other words, as having edges and corners. In general, edges and corners of the compartments can make it difficult to remove small items, such as pills or small screws/nails. Example storage unit 302 is similar to example storage unit 102, with a plurality of storage units 302 capable of being detachably interconnected to form a single unified container. However, according to this embodiment of the present invention, the bottom of each compartment 306*a* and 306*b* is now rounded, as illustrated by arrows 310 (note that FIG. 7 shows a phantom view of the interior of each compartment). This rounded bottom interior makes it easier for a user to scoop items out with a finger, for example. The rounded bottom interior also allows a user to use a scoop, for example, to remove items from compartments 306*a* and 306*b*. Again, the rounded bottom interior of the compartments according to this example embodiment of the invention is applicable to each of the embodiments discussed above.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A pillbox comprising:

a plurality of individual storage units, each individual storage unit comprising a day-of-the-week designation, two side walls, two end walls, a central wall substantially parallel to the two end walls, and a bottom, wherein each individual storage unit comprises:

a first compartment bounded by the two side walls, a first end wall of the two end walls, the central wall, and the bottom;

a second compartment bounded by the two side walls, a second end wall of the two end walls, the central wall, and the bottom, wherein the first and second compartments are configured to have a size to maintain and dispense daily medication;

a first hinged lid for accessing the first compartment, the first hinged lid connected to the central wall and selectively positionable in a first closed position over a top of the first compartment, wherein the first hinged lid is configured to releasably attach to the first end wall in the first closed position;

a second hinged lid for accessing the second compartment, the second hinged lid connected to the central wall and selectively positionable in a second closed position over a top of the second compartment, wherein the second hinged lid is configured to releasably attach to the second end wall in the second closed position; and a first part of a two-part complementary interlocking mechanism on a first side wall of the two side walls, the first part of the two-part complementary interlocking mechanism allowing an individual storage unit to attach releasably to another individual storage unit having a second part of the two-part complementary interlocking mechanism, wherein each individual storage unit is separable from any other attached individual storage unit via the two-part complementary interlocking mechanism.

2. The pillbox of claim 1, wherein the first part of the two-part complementary interlocking mechanism is a first tooth and groove and the second part of the two-part complementary interlocking mechanism is a second tooth and groove, and wherein a groove of the first part is configured to receive a tooth of the second part such that the first and second parts of the two-part complementary interlocking mechanisms interlock with each other.

3. The pillbox of claim 2, wherein the first part of the two-part complementary interlocking mechanism further comprises a stop guard and the second part of the two-part complementary interlocking mechanism further comprises a stop notch, and wherein the stop notch is configured to receive the stop guard in order to align interlocked storage units.

4. The pillbox of claim 1, wherein the first part of the two-part complementary interlocking mechanism comprises a first inner tooth configured to form a first inner groove and a second inner tooth configured to form a second inner groove, the first inner tooth and first inner groove and the second inner tooth and second inner groove being directed inward towards each other.

5. The pillbox of claim 4, wherein the second part of the two-part complementary interlocking mechanism comprises a first outer tooth configured to form a first outer groove and a second outer tooth configured to form a second outer groove, the first outer tooth and first outer groove and the second outer tooth and second outer groove being directed outwards away from each other; and wherein the first and second inner teeth respectively fit within the first and second outer grooves and wherein the first and second outer teeth respectively fit within the first and second inner grooves such that the first and second parts of the two-part complementary interlocking mechanism interlock with each other.

6. The pillbox of claim 5, wherein the first part of the two-part complementary interlocking mechanism further comprises a stop guard and the second part of the two-part complementary interlocking mechanism further comprises a stop notch, and wherein the stop notch is configured to receive the stop guard in order to align interlocked storage units.

7. The pillbox of claim 1, wherein each of the first and second compartments comprises a rounded interior shape to allow items within the first and second compartments to be scooped from the first and second compartments.

8. The pillbox of claim 1, wherein each of the first hinged lid and the second hinged lid comprises a designation of a time of day.

9. The pillbox of claim 1, wherein five of the individual storage units have the first part of the two-part complementary interlocking mechanism on the first side wall of the two sidewalls and the second part of the two-part complementary interlocking mechanism on a second opposed sidewall of the two sidewalls and two of the individual storage units have only the first part or the second part on one of the two sidewalls.

10. The pillbox of claim 1, wherein the first hinged lid comprises an indication of a first time of day and wherein the second hinged lid comprises an indication of a second time of day.

11. A pillbox comprising:

a plurality of individual storage units, each individual storage unit comprising two side walls, two end walls, a central wall substantially parallel to the two end walls, and a bottom, wherein each individual storage unit comprises:

a first compartment bounded by the two side walls, a first end wall of the two end walls, the central wall, and the bottom;

a second compartment bounded by the two side walls, a second end wall of the two end walls, the central wall, and the bottom;

a first hinged lid for accessing the first compartment, the first hinged lid connected to the central wall and selectively positionable in a first closed position over a top of the first compartment, wherein the first hinged lid is configured to releasably attach to the first end wall in the first closed position;

a second hinged lid for accessing the second compartment, the second hinged lid connected to the central wall and selectively positionable in a second closed position over a top of the second compartment, wherein the second hinged lid is configured to releasably attach to the second end wall in the second closed position;

a first part of a two-part complementary interlocking mechanism on a first side wall of the two side walls, the first part of the two-part complementary interlocking mechanism allowing an individual storage unit to attach releasably to another individual storage unit having a second part of the two-part complementary interlocking mechanism, wherein each individual storage unit is separable from any other attached individual storage unit via the two-part complementary interlocking mechanism; and wherein, for each of the individual storage units, the first hinged lid and the second hinged lid are separable from the central wall, the first hinged lid and the second hinged lid each having a tab insertable into a slot of the central wall, the tab being releasably and frictionally held in place in the slot and being removable from the slot.

12. A pillbox utilizing a two-part interlocking system, the two-part interlocking system comprising a first interlocking mechanism and a second interlocking mechanism, the first and second interlocking mechanisms configured to releasably connect neighboring storage units, the pillbox comprising:

a plurality of individual storage units each comprising a first side wall, a second side wall, a first end wall, a second end wall, a central wall substantially parallel to the first end wall and the second end wall, and a bottom, wherein each individual storage unit comprises:

a first compartment bounded by the first side wall, the second side wall, the first end wall, the central wall, and the bottom;

a second compartment bounded by the first side wall, the second side wall, the second end wall, the central wall, and the bottom;

a first hinged lid connected to the central wall and selectively positionable in a first closed position over a top of the first compartment, wherein the first hinged lid is configured to releasably attach to the first end wall in the first closed position; and a second hinged lid connected to the central wall and selectively positionable in a second closed position over a top of the second compartment, wherein the second hinged lid is configured to releasably attach to the second end wall in the second closed position;

wherein the plurality of individual storage units comprises:

a first end storage unit, wherein the first side wall of the first end storage unit comprises the first interlocking mechanism, and wherein the second side wall of the first end storage unit does not include the first interlocking mechanism or the second interlocking mechanism;

five middle storage units, wherein the first side wall of each of the five middle storage units comprises the first interlocking mechanism, and wherein the second side wall of each of the five middle storage units comprises the second interlocking mechanism; and a second end storage unit, wherein the first side wall of the second end storage unit does not include the first interlocking mechanism or the second interlocking mechanism, and wherein the second side wall of the second end storage unit comprises the second interlocking mechanism.

13. The pillbox of claim 12, wherein:

the first interlocking mechanism of the first end storage unit is releasably connectable to the second interlocking mechanism of a first of the five middle storage units;

the first interlocking mechanism of each of the first, a second, a third, and a fourth of the five middle storage units is releasably connectable, respectively, to the second interlocking mechanism of each of the second, the third, the forth, and a fifth of the five middle storage units; and the first interlocking mechanism of the fifth of the five middle storage units is releasably connectable to the second interlocking mechanism of the second end storage unit.

14. The pillbox of claim 12, wherein the first and second hinged lids of each of the first end storage unit, the five middle storage units, and the second end storage unit comprises either an indication of a day of the week or an indication of a time of day.

* * * * *